US009025419B2

(12) United States Patent
Lechot et al.

(10) Patent No.: US 9,025,419 B2
(45) Date of Patent: May 5, 2015

(54) UNIVERSAL TIMEPIECE

(71) Applicant: The Swatch Group Research and Development Ltd., Marin (CH)

(72) Inventors: Dominique Lechot, Reconvilier (CH); Alain Vuilleumier, La Chaux-de-Fonds (CH); Jean-Jacques Born, Morges (CH)

(73) Assignee: The Swatch Group Research and Development Ltd., Marin (CH)

( * ) Notice: Subject to any disclaimer, the term of this patent is extended or adjusted under 35 U.S.C. 154(b) by 59 days.

(21) Appl. No.: 14/029,112

(22) Filed: Sep. 17, 2013

(65) Prior Publication Data

US 2014/0078869 A1 Mar. 20, 2014

(30) Foreign Application Priority Data

Sep. 20, 2012 (EP) ..... 12185275
Oct. 12, 2012 (EP) ..... 12188285

(51) Int. Cl.
*G04B 19/22* (2006.01)

(52) U.S. Cl.
CPC ..... *G04B 19/22* (2013.01); *G04B 19/223* (2013.01)

(58) Field of Classification Search
CPC ..... G04B 19/22; G04B 19/223
USPC ..... 368/21, 27
See application file for complete search history.

(56) References Cited

U.S. PATENT DOCUMENTS

| | | | | |
|---|---|---|---|---|
| 369,462 | A * | 9/1887 | Moyer | 368/27 |
| 2,148,907 | A * | 2/1939 | Kidd | 368/27 |
| 2,169,956 | A * | 8/1939 | Leatart | 368/27 |
| 6,243,324 | B1 * | 6/2001 | Teng | 368/21 |
| 6,788,622 | B1 * | 9/2004 | Garcia | 368/21 |
| 2006/0285443 | A1 * | 12/2006 | Vogt et al. | 368/21 |
| 2010/0124152 | A1 * | 5/2010 | Lee | 368/232 |
| 2012/0075960 | A1 * | 3/2012 | Sun | 368/21 |

FOREIGN PATENT DOCUMENTS

| | | |
|---|---|---|
| CH | 270085 | 8/1950 |
| DE | 20 2007 014 239 U1 | 1/2008 |
| WO | WO 2008/125535 A2 | 10/2008 |
| WO | WO 2012/084314 A1 | 6/2012 |
| WO | WO 2012/123550 A2 | 9/2012 |

OTHER PUBLICATIONS

European Search Report issued Mar. 25, 2013, in European Patent Application No. 12188285, filed Oct. 12, 2012.

* cited by examiner

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

The universal timepiece comprises a winter/summer switching mechanism (27, 29, 31, 25, 19, 19H, 19E, 20, 20H, 20E, 21, 21E, 21H, 22, 22E, 22H, 23, 23E, 23H, 11, 11A, 12, 12A, 13, 13A, 14, 14A, 15, 15A, 17) arranged to be driven intermittently by the movement to selectively displace some of the geographic indications carried by the dial (3) by 1/24th of a turn in order to change by one hour the local time associated with these geographic indications during a change from winter time to summer time or from summer time to winter time.

7 Claims, 5 Drawing Sheets

Fig. 1

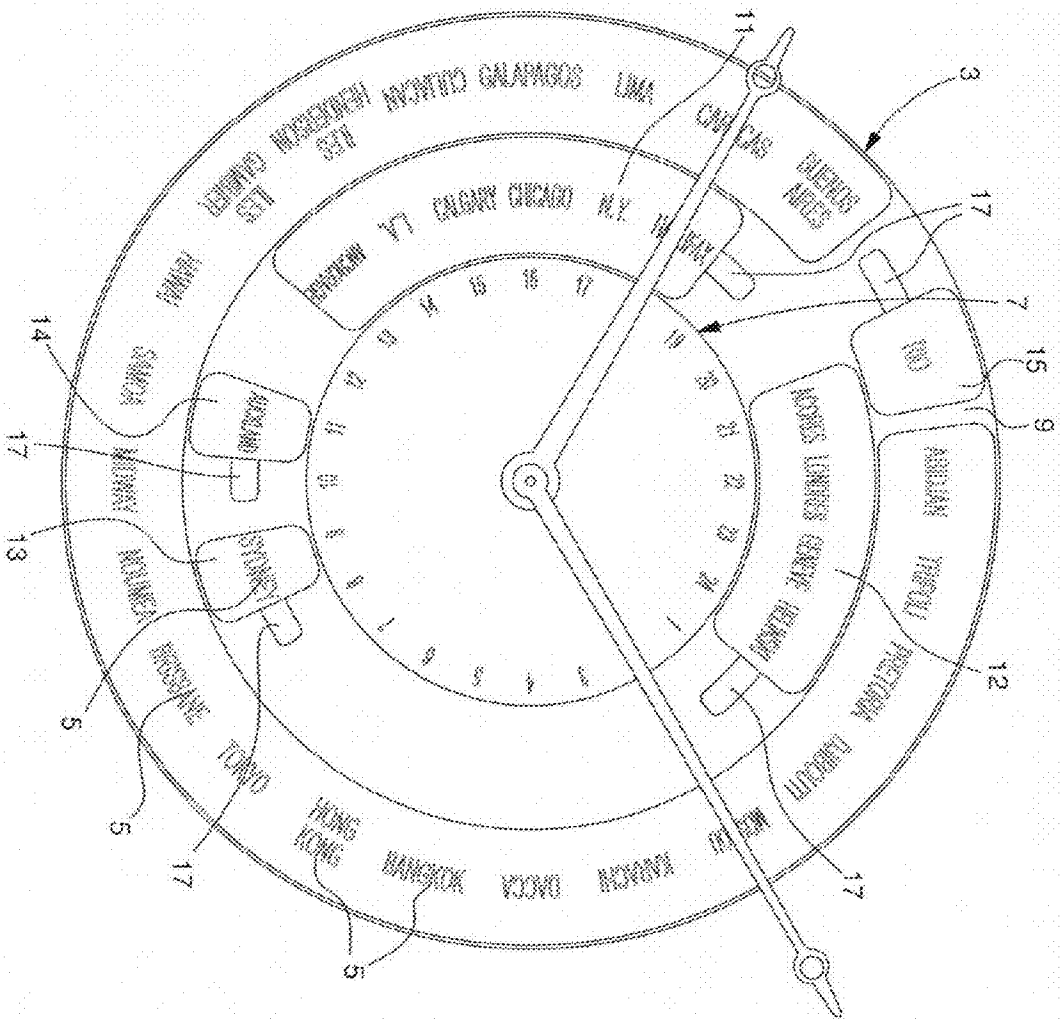
3
17
7
15
9
12
17
11
5
5
17
5
14
17
13
FIJI
ABIDJAN
TRIPOLI
PRETORIA
NAIROBI
ADDIS
LUSAKA
CAIRO
HARARE
KARACHI
DOHA
MOSCOW
JEDDAH
DUBAI
ABU DHABI
MUSCAT
TEHRAN
BAGHDAD
ISTANBUL
ATHENS
L.A.
MEXICO CITY
CHICAGO
CHARLOTTE
NEW YORK
MIAMI
HAVANA
CARACAS
LIMA
SANTIAGO
BUENOS AIRES
SAO PAULO
RIO
NOUMEA
WELLINGTON
SYDNEY
BRISBANE
TOKYO
SEOUL
BEIJING
HONG KONG
MANILA
BANGKOK
YANGON
DHAKA
KATHMANDU
NEW DELHI
MUMBAI
DUBAI
ABU DHABI
MUSCAT
TEHRAN
BAGHDAD
ISTANBUL
ATHENS
L.A.
MEXICO CITY
CHICAGO
CHARLOTTE
NEW YORK
MIAMI
HAVANA
CARACAS
LIMA
SANTIAGO
BUENOS AIRES
SAO PAULO
RIO
NOUMEA
WELLINGTON
SYDNEY
BRISBANE
TOKYO
SEOUL
BEIJING
HONG KONG
MANILA
BANGKOK
YANGON
DHAKA
KATHMANDU
NEW DELHI
KARACHI
DOHA
MOSCOW
JEDDAH

UNIVERSAL TIMEPIECE

This application claims priority from European Patent Application No. 12185275.0 filed Sep. 20, 2012 and European Patent Application No. 12188285.6 filed Oct. 12, 2012 the entire disclosure of which is incorporated herein by reference.

FIELD OF THE INVENTION

The present invention relates to a so-called universal timepiece, the dial of which allows quick reading of the time of different time zones. More specifically, it relates to such a timepiece comprising a first dial bearing geographic indications corresponding to the different time zones and defining a 24-hour circle, and comprising a second dial bearing a 24-hour hour-circle, wherein the second dial is movable concentrically to the first dial and is arranged to be rotated by the movement of the timepiece at a rate of one turn in 24 hours, wherein the time indications are arranged to face the geographic indications of the first dial to indicate local times.

PRIOR ART

Universal timepieces corresponding to the above definition are known. Swiss patent CH 270,085 in particular describes a universal watch comprising a fixed central twelve-hour dial, over which hour, minute and second hands turn in a conventional manner. A first 24-hour annular dial is mounted to be rotatable around the central dial. This annular dial is arranged to be driven by the movement in the opposite direction of the hands of the watch at a rate of one turn in twenty four hours. It is also synchronised with the hands so that passage of the 12 hour and 24 hour indications in the "12 o'clock" position of the watch occurs at the instant the hands are superposed at 12 o'clock. A second annular dial bearing geographic indications corresponding to time zones is mounted to be rotatable around the first annular dial. It is arranged to be displaced manually by means of a button, the stem of which terminates in a conical pinion meshing with a peripheral toothing of the second annular dial.

To know the time in a given location, the user of this watch of the prior art must use the button to turn the second annular dial and bring the name of the location where he/she is located to the "12 o'clock" position of the watch. The two dials thus allow the corresponding time in each of the time zones of the world to be read. Thus, as illustrated in this document of the prior art, when it is eight o'clock in the evening in New York, it is one o'clock in the morning in Paris, ten o'clock in Tokyo and six o'clock in the evening in Mexico.

A known problem with this type of universal watch relates to the change from winter time to summer time and vice versa. In fact, because of this twice-yearly time change, the time difference between two locations is not always constant. On the contrary, when the time change does not take place at the same time in the two locations in question, the seasonal time change is accompanied by variations in time difference. This is usually the case in particular when one of the two locations is located in the northern hemisphere and the other in the southern hemisphere. Moreover, it is naturally always the case when the country where one of the locations is situated does not have daylight saving time, whereas the country where the other location is situated does.

Because of the abovementioned problem, the indications provided by the majority of known universal watches are only exact in certain standard situations and are incorrect in a certain number of atypical situations.

The pending patent application WO2012/123550 describes a universal timepiece, which comprises manual means arranged to enable a user to selectively displace certain geographic indications carried by the dial in order to change the local time associated with these geographic indications by one hour during the change from winter time to summer time, or vice versa. A disadvantage of this older solution is that the user must be up-to-date with the dates of time changes associated with the geographic indications to be displaced.

BRIEF OUTLINE OF THE INVENTION

An aim of the present invention is to remedy the disadvantages of the abovementioned prior art. The present invention achieves this aim by providing a universal timepiece according to the attached claim 1.

It will be understood that the timepiece of the invention comprises a days of the week counter and that it is this counter that rotates the operating element. In fact, the change from winter time to summer time does not take place at a fixed date as a rule, but actually on a fixed day. More precisely, a widely followed custom holds that the change from winter time to summer time as well as the change from summer time to winter time should systematically occur at a weekend late at night from Saturday to Sunday, or in other words early on Sunday morning. In these conditions, it will be understood that it is advantageous if the operating element according to the invention is driven once a week at maximum by a days of the week counter.

BRIEF DESCRIPTION OF THE FIGURES

Other features and advantages of the present invention will become clear on reading the following description given solely by way of non-restrictive example with reference to the attached drawings:

FIG. 1 is a plan view showing in particular the first and the second dial of a universal watch according to a variant of the invention;

DETAILED DESCRIPTION OF TWO EMBODIMENTS

Figure 3:
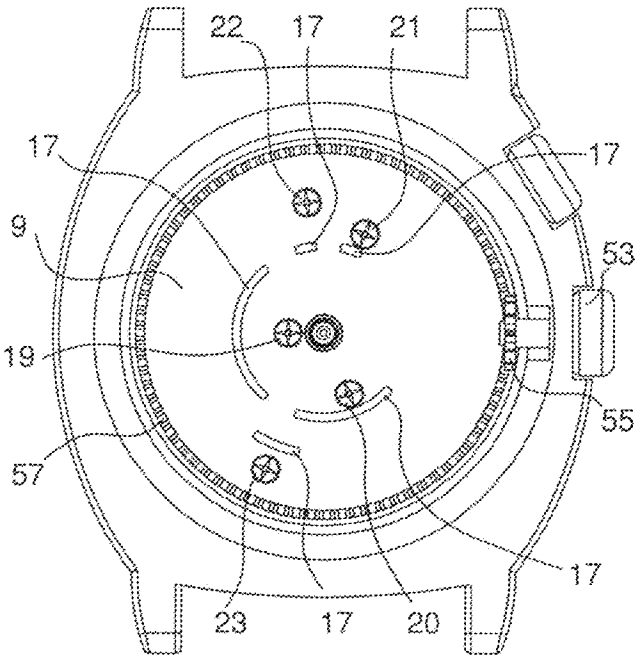
FIG. 3 is a view similar to FIG. 2, wherein the rotating actuating element and the jumpers have also been removed in order to show the first dial.

FIG. 1 is a partial plan view from the dial side of a universal watch corresponding to a particular variant of the invention. Only those elements of the watch that directly relate to the invention are shown in FIG. 1. The other elements such as the watch case, the part of the dial carrying the 12-hour hour-circle intended to cooperate with the hands or also the winding and time-setting button have been omitted in the interests of simplification.

FIG. 1 shows two dials in the form of concentric discs respectively given the references 3 and 7. The first of these two dials (given the reference 3 in FIG. 1) bears a plurality of geographic indications 5 distributed around its circumference. These geographic indications are associated with 24 time zones over the globe. The second dial 7 is concentric to the first dial. It has a 24-hour hour-circle provided to cooperate with the geographic indications of the first dial to indicate local times. The dial 7 is arranged to be rotated by the movement of the watch in anti-clockwise direction at a rate of one turn per 24 hours. It should be noted that the second dial could equally be driven in clockwise direction. However, in this case the sequence of both the hours on the hour circle of the second dial and of the geographic indications on the first dial should be reversed.

The first dial 3 is formed from a dial support (plate) 9 and movable dial sectors (11, 12, 13, 14 and 15) mounted to slide on the plate. It is evident in FIG. 1 that the movable dial sectors bear certain geographic indications 5, while other geographic indications 5 are placed directly on the plate 9 of the dial. It can also be seen that the plate 9 has a certain number of oblong openings 17 through it that define circular arcs concentric to the dial. As will be seen in more detail below, the different movable sectors 11 to 15 are arranged to each slide inside one of the oblong openings 17 so that they can be angularly displaced by ½4th of a turn in relation to the rest of the first dial.

The geographic indications 5 that are carried by the same movable dial sector designate locations where the change between summer time and winter time occurs on the same date in either direction. For example, it is evident from FIG. 1 that the dial sector given the reference 12 bears—from left to right—the geographic indications: "Azores", "London", "Geneva" and "Helsinki". It can be seen that the time change clearly takes place on the same dates in these four locations. In fact, it has been decided that, until further notice, the change to summer time will take place in this part of the globe on the last Sunday in March and the return to winter time will take place on the last Sunday in October. It can also be seen from FIG. 1 that the dial sector given the reference 11 bears—from left to right—the geographic indications: "Anchorage", "L.A.", "Calgary", "Chicago", "N.Y." and "Halifax". These six cities are all located in the United States or Canada and in these regions the change to summer time currently takes place on the second Sunday in March, while return to winter time takes place on the first Sunday in November.

According to the variant illustrated in FIG. 1, three other sliding sectors (given references 13, 14 and 15) each bear a single geographic indication. Each of these three geographic indications corresponds to a location in the southern hemisphere where, as is well known, the seasons are reversed in relation to the northern hemisphere. For example, in Sydney (dial sector 13) and in southern Australia the change to summer time takes place on the first Sunday in October and the return to winter time takes place on the first Sunday in April of the following year. In Auckland (dial sector 14) and in the rest of New Zealand the change to summer time takes place on the last Sunday in September and the return to winter time takes place on the first Sunday in April of the following year. Finally, in Rio de Janeiro (dial sector 15) the change to summer time takes place on the third Sunday in October and the return to winter time takes place on the third or fourth Sunday in February of the following year.

It can be seen that in the variant shown in FIG. 1 the first dial also Bears—from left to right—the geographic indications: "Abidjan", "Tripoli", "Pretoria", "Djibouti", "Moscow", "Karachi", "Dacca", "Bangkok", "Hong Kong", "Tokyo", "Brisbane", "Noumea", "Midway", "Samoa", "Hawaii", "Gambier Islands" "Henderson Island", "Culiacan", "Galapagos", "Lima", "Caracas" and "Buenos Aires". The latter geographic indications correspond to the locations where there is no summer time. Therefore, as there is no seasonal time change in these regions the corresponding geographic indications do not need to be on movable dial sectors and can therefore be located directly on the plate 9 of the first dial.

Figure 2:
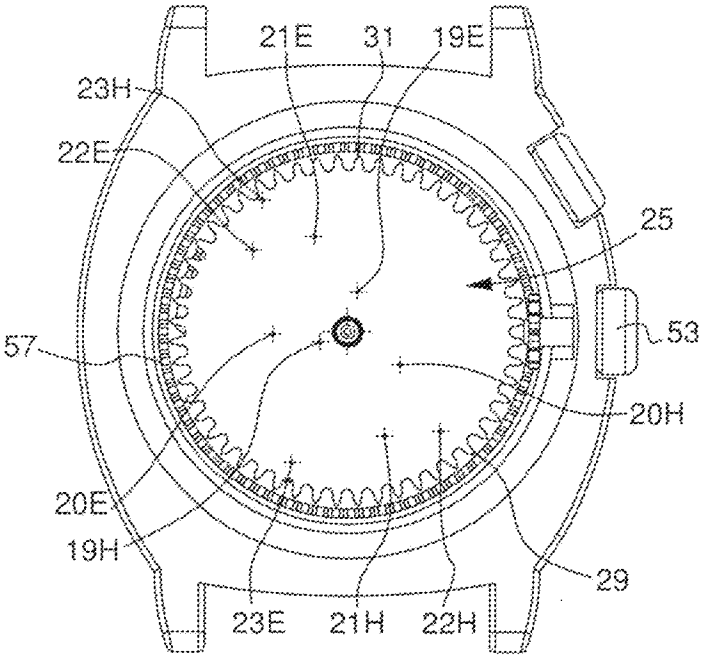
FIG. 2 is a plan view from the back side of the universal watch of FIG. 1, wherein the movement has been removed from the watch to enable the rotating actuating element to be seen.

As shown in FIGS. 2 and 3, the first dial 3 can be rotated manually by means of a manual control element that can be actuated from outside the middle of the case. In the present example, this control element is configured in the form of a button 53, the stem of which bears a pinion 55 that meshes with a peripheral rim toothing 57 of the first dial. It will be understood that this arrangement allows the wearer of the watch to rotate the first dial 3, and therefore all the geographic indications 5 that it bears, by operating the button 53.

FIG. 3 is a view from the back side of the watch, wherein the back-plate and the movement have been removed to provide a plan view of the plate 9 of the dial 3. As already mentioned, the plate 9 has a certain number of oblong openings 17 passing through it that define circular arcs concentric to the dial. In the variants shown, these arcs are not all subtended by the same circle. A first circle subtends four of them, while the fifth is on a circle of larger diameter. It can also be seen from FIG. 3 that the lower face of the plate 9 also bears five small star wheels (respectively given references 19, 20, 21, 22 and 23). Each of the star wheels is formed by a four-pointed star integral to a small toothed wheel. The five star wheels are rotatably mounted under the plate 9. It is additionally clear that in the present example the distances that separate each of the different star wheels from the axis of the watch are all different.

Figure 4:
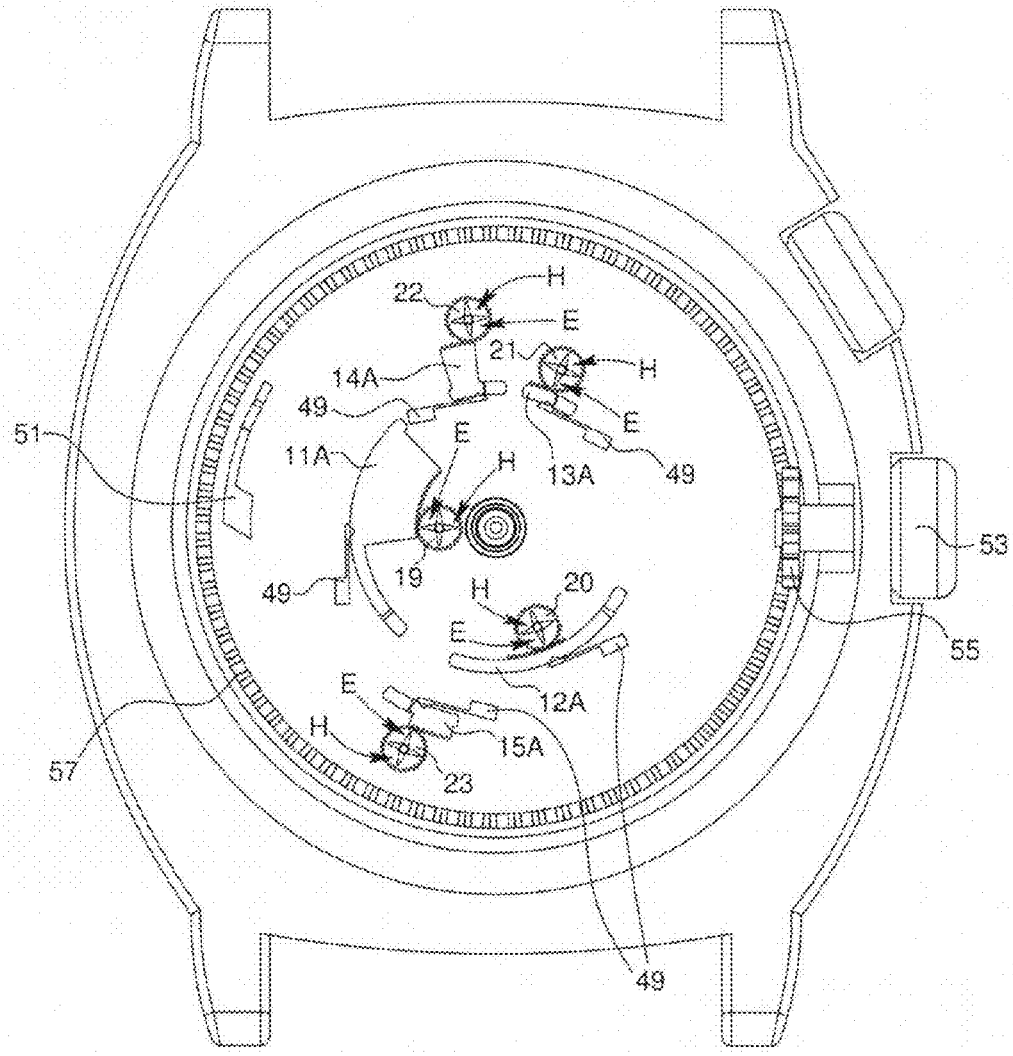
FIG. 4 is a similar view to FIG. 3 also showing the toothed feet of the movable dial sectors and the jumpers.

As has been stated above, the movable dial sectors 11, 12, 13, 14 and 15 are arranged to slide into the openings 17. For this, the movable dial sectors have legs, which are inserted into the oblong openings so that the end of the legs come out below the plate 9 of the first dial. The end of each leg additionally bears a foot in the form of a toothed sector. FIG. 4 is similar to FIG. 3 and additionally shows how the toothed sectors (respectively given references 11A, 12A, 13A, 14A and 15A) each mesh with one of the small star wheels. It will therefore be understood that each rotation of one of the small star wheels causes the corresponding dial sector to slide inside its oblong opening. Finally, FIG. 4 also shows five jumper springs 49 provided to selectively hold the dial sectors either in the position corresponding to winter time or in the position corresponding to summer time.

The timepiece according to the invention also comprises a rotating actuating element 25, which is arranged to switch over the movable dial sectors 11 to 15 from their winter position to their summer position or vice versa. In the example illustrated in FIG. 2, the rotating actuating element is formed by a programming disc 25. The programming disc is mounted to turn under the support 9 of the first dial 3 (cf. FIG. 3) coaxially with the latter. The programming disc 25 forms part of the winter/summer switching mechanism and, as will be seen in more detail below, it is arranged to be driven intermittently by the movement. The function of the programming disc is to determine the moment at which each of the different movable dial sectors 11, 12, 13, 14 and 15 is actuated. In the view provided by FIG. 2 from the back-side of the watch, the programming disc almost completely screens the plate 9 of the first dial, of which only the peripheral toothing 57 is visible. It will be understood, moreover, that the toothed sectors 11A, 12A, 13A, 14A and 15A and the small star wheels 19, 20, 21, 22 and 23 are housed between the programming disc 25 and the first dial 3. Therefore, they are not visible in FIG. 2. However, it can be seen that the programming disc is provided with ten pins given references 19H, 19E, 20H, 20E, 21 E, 21 H, 22E, 22H, 23E and 23H. It should be noted that the pins are arranged on the face of the programming disc 25 facing the plate 9 and therefore are actually not visible in FIG. 2. However, in the present example, the pins are driven into holes in the programming disc. It is these holes that are shown in FIG. 2.

As may be seen in FIG. 2, in the illustrated example the distances that separate the ten pins from the axis of the watch are all different. Moreover, these distances increase in the sequence of pins 19H, 19E, 20H, 20E, 21E, 21H, 22E, 22H, 23E, 23H. When the movement of the watch actuates and rotates the programming disc 25, each of the pins carried by the disc is displaced along a circular trajectory, the radius of which is equal to the distance separating this pin from the axis of the hands of the watch. It has already been mentioned above that the distances separating the five star wheels from the axis of the watch are also all different. In fact, each star wheel is arranged so that its star intercepts the trajectory of two quite specific pins. Thus, the star wheel 19 is arranged to intercept the circular trajectories of pins 19H and 19E, the star wheel 20 is arranged to intercept the trajectories of pins 20H and 20E and so on.

The pin 19H (FIG. 2) is located slightly closer to the axis of the hands of the watch than the axis of the star wheel 19 (FIGS. 3 and 4). Thus, it will be understood that when the pin 19H turns and encounters the star wheel 19, it causes it to rotate a quarter turn in the opposite direction to the direction of rotation of the programming disc. Conversely, the pin 19E (FIG. 2) is located slightly further away from the axis of the hands of the watch than the star wheel 19. Thus, when the pin 19E encounters the star wheel 19, it causes it to rotate a quarter turn in the same direction as the programming disc. Moreover, as can also be seen in FIG. 4, the toothing of the toothed sector 11A is an internal toothing (in other words, facing the axis of the hands of the watch). In these conditions, it will be understood that when the star wheel 19 drives the toothed sector 11A, the latter turns in the same direction as the star wheel. In these conditions, when the pin 19E encounters the star of wheel 19 and as a result the latter performs a rotation of a quarter turn in the direction of the hands of the watch, this rotation causes the movable dial sector 11 to slide also in the direction of the hands of the watch. This means that the pin 19E causes the movable dial sector 11 to move to summer time. The reverse is the case with pin 19H. In fact, as has been seen, pin 19H causes the star wheel 19 to turn in the reverse direction. Thus, it will be understood that the pin 19H is arranged to cause the movable dial sector 11 to move back to winter time when it encounters the star wheel.

Referring once again to FIGS. 2 and 3, it can also be seen that the pins are arranged on the programming disc 25 such that each encounter of one of the pins with a star wheel corresponds to a different angular position of the programming disc. Moreover, the relation between the position of the pins and that of the star wheels is such that when the programming wheel turns in clockwise direction, the pins interact with their star in the sequence 23H, 19E, 20E, 21H, 22H, 22E, 21E, 23E, 20H and finally 19H. As will be seen in more detail below, the winter/summer switching mechanism, to which the present description relates, allows the changes back and forth between winter time and summer time to be correctly controlled even when the precise dates of these changes vary from one year to the next, provided that these changes take place in the same week each year. However, it should be noted that if a political decision results in something changing in this succession of time changes, it will suffice to change the programming wheel 25 to adjust the watch to the new situation.

Figure 5:
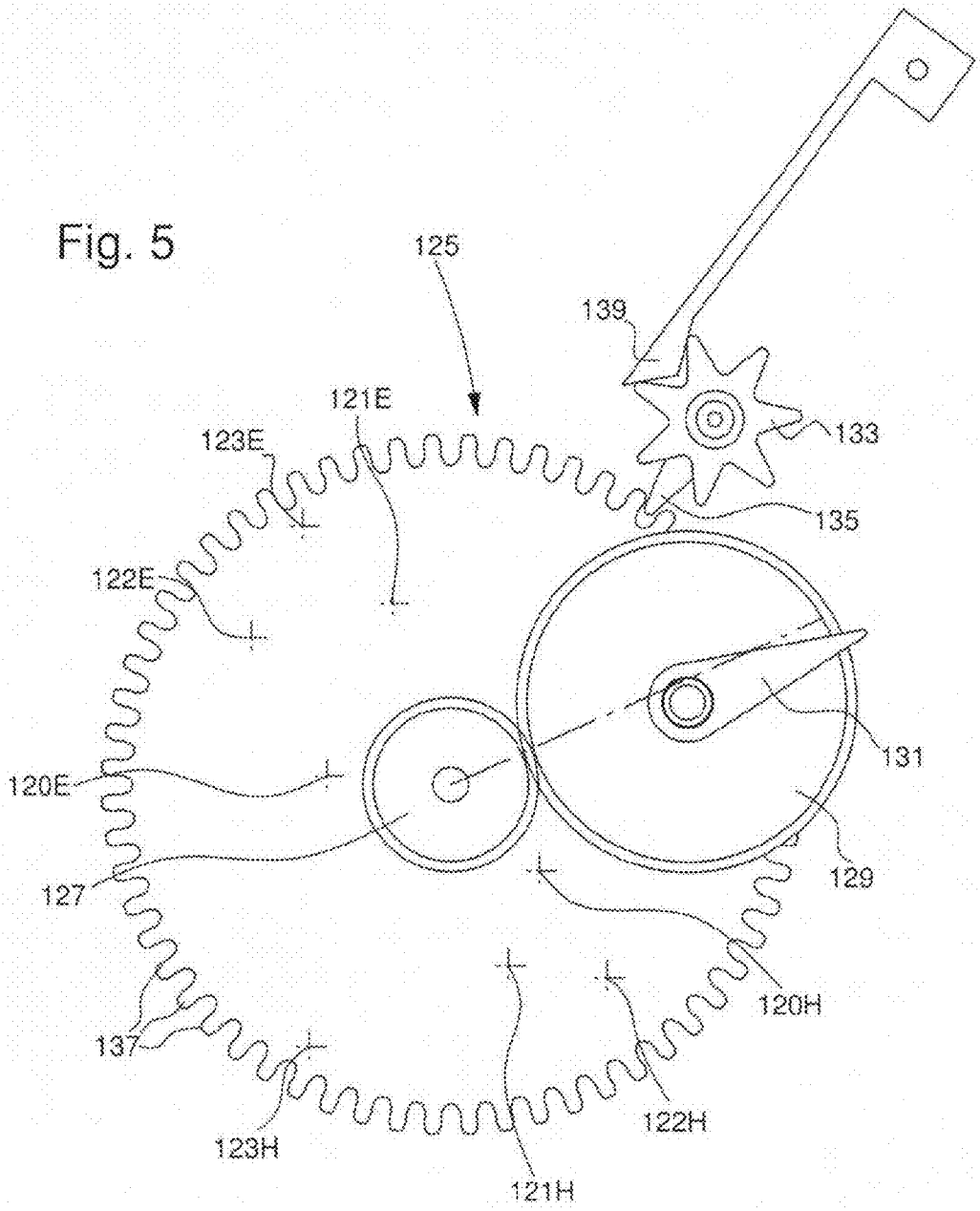
FIG. 5 is a partial plan view of a first embodiment of the invention showing more specifically the rotating actuating element and the kinematic chain that allow this element to be driven intermittently by the movement.
Figure 7:
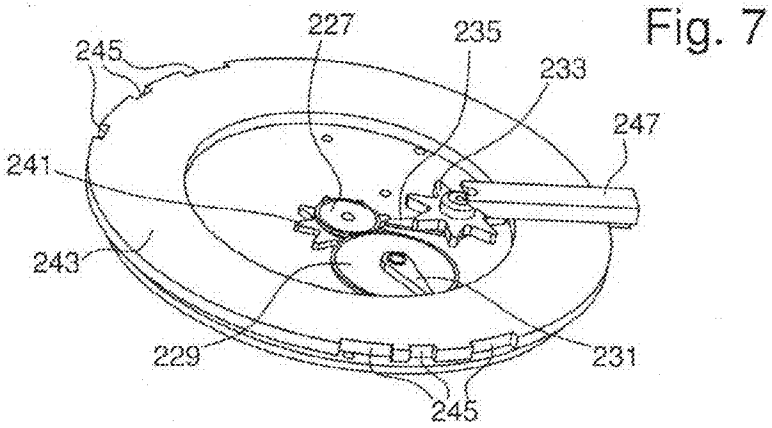
FIGS. 6A, 6B, 7 and 8 show, in plan view, sectional view and perspective view respectively, the winter/summer switching mechanism of a universal watch according to a second embodiment of the invention.
Figure 8:
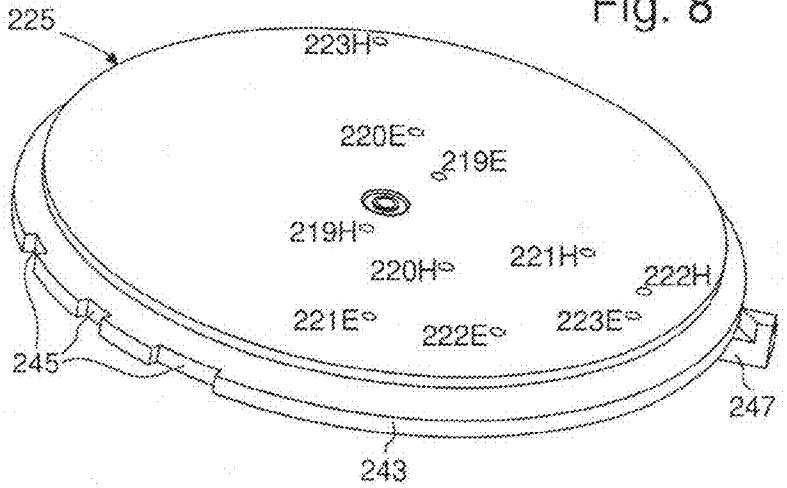
Figure 6A:
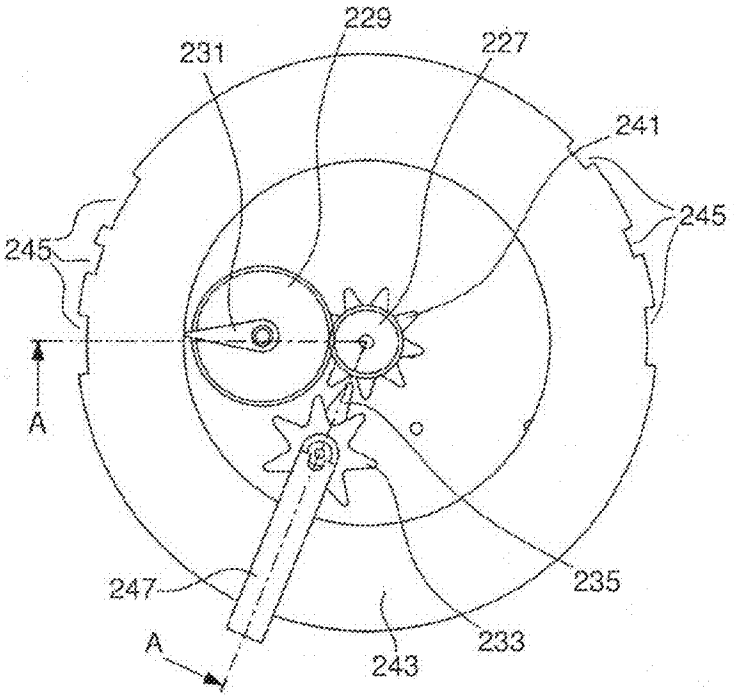
Figure 6B:
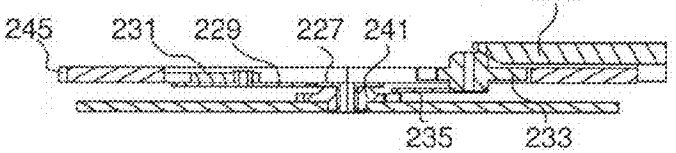

FIG. 5 is a partial plan view from the base side of a first embodiment of the invention that schematically shows the winter/summer switching mechanism and more specifically the kinematic chain arranged to allow the movement of the times piece to drive the rotating actuating element intermittently. In the illustrated example the timepiece can be the universal watch described above. Thus, the rotating actuating element illustrated in FIG. 5 is a toothed disc 125 similar to the programming disc 25 that has been described in relation to FIGS. 2 to 4. However, it will be understood that instead of being in the form of a toothed disc the rotating operating element of the invention could equally be in the form, for example, of a ring with an internal toothing or even in the form, for example, of a rotary cylinder fitted with pins.

Still referring to FIG. 5, it shows a wheel 127 positioned under the toothed disc 125 concentrically to the latter. The wheel 127 meshes with a wheel 129 carrying a finger 131. FIG. 5 also shows a seven-pointed star 133 positioned by a jumper 139. The seven-pointed star is arranged to face both the wheel 129 and the toothing of the toothed disc 125. The star 133 itself bears a finger 135 arranged to cooperate with the teeth 137 of the disc 125. As mentioned, in the present example the toothed disc 125 is a programming disc fitted with pins. It is similar to the programming disc 25 and is mounted to rotate around the axis of the hands of the watch (not shown in FIG. 5). A jumper mounted under the support 9 of the dial is arranged to hold the programming disc in place with the dial 3. This jumper can be the jumper-spring 51 illustrated in FIG. 4.

The wheel 127 is the hour wheel of the movement. It classically performs one rotation in twelve hours. The wheel 129, or drive wheel of the seven-pointed star, has twice as many teeth as the hour wheel 127 so that the wheel 129 performs on rotation in twenty four hours. The wheel 129 can act on the seven-pointed star 133 by means of the finger 131. Once a day or once a night, the finger 131 actuates the seven-pointed star forcing the jumper 139 to rise so that the star advances by one tooth. The seven-pointed star thus performs one complete rotation per week. It thus forms a days of the week counter. Because of the finger 135 that it carries, the star 133 can itself act on the programming disc 125. Thus, when the days of the week counter 133 passes from Saturday to Sunday, the finger 135 actuates disc 125 forcing the jumper 51 (FIG. 4) to rise such that the programming disc advances by a tooth lead 137. It should be noted that the jumper 51 should not be too strong so that the disc 125 can turn without entraining the first dial 3 with it. It will be understood from the above that the programming disc 125 is arranged to advance by jumps and that, whenever a pin encounters one of the small star wheels during the advance, one of the movable dial sectors 11 to 15 is displaced ½₄th of a turn moving from winter time to summer time or vice versa.

As already explained, the ten pins (eight of which with respective references 120H, 120E, 121E, 121H, 122E, 122H, 123E and 123H are visible in FIG. 5) are arranged on the programming disc 125 such that each encounter of one of the pins with a star wheel corresponds to a different angular position of the programming disc. Since there are only ten pins in the present example, and over the course of the year the programming disc successively occupies as many different angular positions as there are weeks in a year, the majority of displacements of the programming disc 125 do not affect the first movable geographic indications. FIGS. 6A, 6B, 7 and 8 are views of a universal watch according to a second embodiment of the invention. According to this second embodiment, the programming disc is actuated solely during the weeks where one of the first geographic indications must be switched.

Referring now to FIGS. 6A, 6B, 7 and 8, it can be seen that many of the elements forming the winter/summer switching mechanism according to this second embodiment are identical to the elements of the switching mechanism of the first embodiment. In the figures the elements located identically to FIG. 5 in FIGS. 6A, 6B, 7 and 8 are given the same references in the latter figures but increased by 100. To start, the hour wheel of the movement has the reference 227. The drive wheel of the seven-pointed star has the reference 229 and it performs one rotation in twenty four hours. The wheel 229 can act on the seven-pointed star 233 by means of finger 231. Once a day the finger 231 actuates the seven-pointed star such that the star advances by one tooth. It thus performs one complete rotation per week and because of its finger 235 the star 233 can itself act on a ten-pointed star 241 which is integral and concentric to the programming disc 225. In this second embodiment the seven-pointed star 233 is movable vertically between an engaged position, in which the finger 235 can actuate the ten-pointed star 241, and a disengaged position, in which the finger 235 does not intersect the trajectory of the teeth of the star 241.

A coupling mechanism is provided to switch the seven-pointed star 233 between the engaged position and the disengaged position. This mechanism comprises a cam 243 in the form of a ring having a plurality of notches 245. The cam 243 is driven by the movement so that it performs one rotation per year and the positions occupied by the notches 245 correspond to the weeks of the year, during which at least one of the first movable geographic indications must change its position. The coupling mechanism also comprises a cam follower 247, which is elastically restored against the cam 243. The cam follower 247 has an inclination arranged to face the seven-pointed star 233 (visible in particular in FIG. 6B). When the cam follower 247 falls into one of the notches 245, it slides in the direction of the seven-pointed star and its inclination comes to rest against the upper part of the star forcing this to drop until the finger 235 is located in the same plane as the ten-pointed star 241. The seven-pointed star is then located in the engaged position. It will be understood that according to the second embodiment the cam follower 247 drops into a notch each time one of the first movable geographic indications has to be displaced. The rest of the time when no geographic indication has to be switched the seven-pointed star is disengaged and the programming disc is not actuated during passage from Saturday to Sunday. Thus, the programming disc does not perform a rotation in fifty two or fifty three steps, but performs one complete rotation in as many steps as there are switches to be made on the movable dial sectors (ten steps in the present example).

It will be understood that various modifications and/or improvements evident to a person skilled in the art can be made to the embodiments described in the present description without departing from the framework of the present invention as defined by the attached claims. In particular, even though the described embodiments comprise precisely five movable dial sectors, a person skilled in the art will understand that the number of first movable geographic indications is absolutely arbitrary. In fact, there is a vast choice of geographic indications to choose from to represent the different time zones on the dial. In particular, in all time zones without exception there are locations in which there is no summer time.

What is claimed is:

1. A universal timepiece comprising a timepiece movement, a first dial bearing geographic indications corresponding to different time zones and defining a 24-hour circle, and a second dial, which is a 24-hour dial concentric to the first dial and arranged to be rotated by the movement, wherein the second dial bears time indications arranged to face the geographic indications of the first dial to indicate local times, wherein the geographic indications include first geographic indications corresponding to locations where daylight saving time is currently implemented, wherein the first geographic indications are movable on the first dial and are arranged to be switched between first positions and second positions, the first positions corresponding to winter time and the second positions corresponding to summer time and being angularly displaced by 1/24th of a turn in relation to the first positions, in that the timepiece comprises a winter/summer switching mechanism driven by the movement, wherein the switching mechanism comprises a rotating actuating element arranged to be driven intermittently by the timepiece movement so that the actuating element performs a complete rotation in one year turning in jumps, and the actuating element is arranged so that its rotation causes each of the first geographic indications to switch once in one direction and once in the other during the course of a year, the timepiece additionally comprises a days of the week counter driven by the movement and arranged to drive the operating element to rotate during passages from Saturday to Sunday.

2. The universal timepiece of claim 1, wherein the first geographic indications are carried by movable dial sectors, at least one of which movable dial sectors bears several first geographic indications corresponding to different time zones, wherein the first geographic indications carried by the same movable dial sector designate the locations where the passages between summer time and winter time are on the same date in either direction.

3. The universal timepiece of claim 1, wherein the rotating actuating element comprises a disc or a cylinder provided with pins.

4. The universal timepiece of claim 1, wherein the days of the week counter is arranged to cause the actuating element to advance one step during each passage from Saturday to Sunday.

5. The universal timepiece of claim 4, wherein the rotating actuating element comprises a coaxial toothing, wherein the toothing is formed from 52 or 53 teeth and the days of the week counter is arranged to cause the actuating element to advance by one tooth during each passage from Saturday to Sunday.

6. The universal timepiece of claim 1, wherein the winter/summer switching mechanism comprises:

a disengageable kinematic linkage between the days of the week counter and the rotating actuating element, wherein the kinematic linkage is arranged such that the days of the week counter drives the rotating actuating element during passages from Saturday to Sunday as long as the kinematic linkage is not disengaged, a year cam having a plurality of notches or nicks corresponding to the weeks of the year, during which at least one of the first geographic indications must be changed from winter time to summer time or vice versa, a disengagement mechanism controlled by the year cam and arranged to disengage the kinematic linkage so that the days of the week counter does not drive the rotating actuating element during weeks where none of the first geographic inductions must be changed.

7. The universal timepiece of claim 6, wherein the year cam is integral to a coaxial toothing formed from 52 or 53 teeth, wherein the days of the week counter carries a finger arranged to cooperate with the toothing once a week.

* * * * *